US005498924A

United States Patent [19]

Northrop

[11] Patent Number: 5,498,924

[45] Date of Patent: Mar. 12, 1996

[54] FLUORESCENT LAMP CAPABLE OF OPERATING ON MULTIPLE BALLAST SYSTEM

[75] Inventor: Donald P. Northrop, Glen Rock, N.J.

[73] Assignee: Duro-Test corp., Fairfield, N.J.

[21] Appl. No.: 486,742

[22] Filed: Jun. 7, 1995

Related U.S. Application Data

[63] Continuation of Ser. No. 87,518, Jul. 2, 1993, abandoned.

[51] Int. Cl.[6] ..... H01J 63/04

[52] U.S. Cl. ..... 313/486; 313/484; 313/493

[58] Field of Search ..... 313/484, 487, 313/493, 486

[56] References Cited

U.S. PATENT DOCUMENTS

| | | | |
|---|---|---|---|
| 3,129,085 | 4/1964 | Olsen et al. | 65/109 |
| 3,164,657 | 2/1965 | Olsen | 220/2.1 R |
| 3,560,786 | 2/1971 | Shurgan | 313/493 |
| 3,562,571 | 2/1971 | Evans et al. | 313/490 |
| 3,988,633 | 10/1976 | Shurgan et al. | 313/492 |
| 4,427,919 | 1/1984 | Grenfell | 313/546 |
| 4,701,673 | 10/1987 | Lagree et al. | 315/244 |
| 4,891,550 | 1/1990 | Northrop et al. | 313/487 |
| 5,034,655 | 7/1991 | Murayama et al. | 313/493 |
| 5,049,779 | 9/1991 | Itsuki et al. | 313/486 |
| 5,231,328 | 7/1993 | Hisamune et al. | 313/487 |
| 5,247,228 | 9/1993 | Roche | 315/53 |

*Primary Examiner*—Donald J. Yusko
*Assistant Examiner*—Lawrence O. Richardson
*Attorney, Agent, or Firm*—Darby & Darby

[57] ABSTRACT

A fluorescent lamp that has a T10 outer diameter which is capable of operating on ballasts of both the T8 and T12 types. In addition to the T10 diameter, the lamp has at least one groove in its wall to reduce the envelope cross-section, a fill gas of neon and argon, preferably 25% neon and 75% argon and a controlled amount of mercury.

17 Claims, 1 Drawing Sheet

FLUORESCENT LAMP CAPABLE OF OPERATING ON MULTIPLE BALLAST SYSTEM

This is a continuation of application Ser. No. 08/087,518, filed Jul. 2, 1993 now abandoned.

BACKGROUND OF THE INVENTION

Fluorescent lamps are classified in terms of "T" dimensions with each T unit corresponding to 0.125 inches of diameter. Thus a T-8 lamp has a nominal 1 inch diameter and a T12 lamp a nominal 1.50 inch diameter.

Each type of lamp is designed to operate on a specific type of ballast. That is, while a T8 lamp will operate on a ballast of T8 design, it will operate very inefficiently, if at all, on a ballast designed for T12 lamps, and vice versa. In addition, ballasts are of two types. These are the magnetic type, using the conventional lamination and coil structure, and the electronic type, which uses electronic components to produce a relatively high frequency operating voltage. When using an electronic ballast, the possibility of a lamp of different T value than the ballast design makes proper operation even more difficult.

Accordingly, it would be desirable to produce a fluorescent lamp of one size which can be used with a variety of ballasts, both of the magnetic and electronic type, as well as designed for different size fluorescent lamps.

BRIEF DESCRIPTION OF THE INVENTION

The present invention relates to a fluorescent lamp of one size which is capable of operating with several ballast sizes and of both the electromagnetic and electronic types. More particularly, the invention relates to a fluorescent lamp with a T10 envelope dimension which can successfully operate with T8 electromagnetic and electronic ballasts and a T12 electronic ballast.

The novel lamp of the present invention is accomplished by using a T10 envelope with one or more grooves along a portion of the length of the wall thereof to control the envelope cross section. The groove or grooves can be helical or discontinuous. In addition, the lamp has a unique fill gas mixture and uses particular types of phosphor blends.

The combination of the three factors, i.e., envelope diameter and cross section, fill gas mixture and phosphor blend, produces the desired result of a single lamp which is able to successfully operate on three different types of ballast systems with comparable light (lumen) output and lamp life to the specific two types of lamps, i.e., T8 and T12, it replaces. In addition, the phosphor blend plays a role in controlling lumen output as well as determining the spectral power distribution, correlated color temperature (K° ) and color rendering index (CRI) of the lamp.

The lamp of the subject invention has the advantages of being suitable for use in luminaires equipped with either the electromagnetic or electronic type of T8 ballast and also with T12 electronic ballasts. The latter type of ballast is becoming increasingly important due to its inherent lower wattage loss characteristics, size and weight reduction as compared to magnetic ballasts. The advantages of the electronic ballast are realized as a result of the high frequency operation of the electronic ballast.

OBJECT OF THE INVENTION

It is therefore an object of the invention to provide a novel fluorescent lamp of one size which is capable of operating on different sizes and types of ballast systems.

An additional object is to provide a fluorescent lamp of T10 dimension which is capable of successfully operating with T8 lamp size magnetic and electronic ballasts and well as T12 lamp size electronic ballasts.

An additional object is to provide a T10 fluorescent lamp envelope having a specific cross section, gas fill and phosphor combination which permits the lamp to successfully operate with a variety of sizes and types of ballasts.

BRIEF DESCRIPTION OF THE DRAWINGS

Other objects and advantages of the present invention will become more apparent upon reference to the following specification and annexed drawings in which.

DETAILED DESCRIPTION OF THE INVENTION

Figure 1:
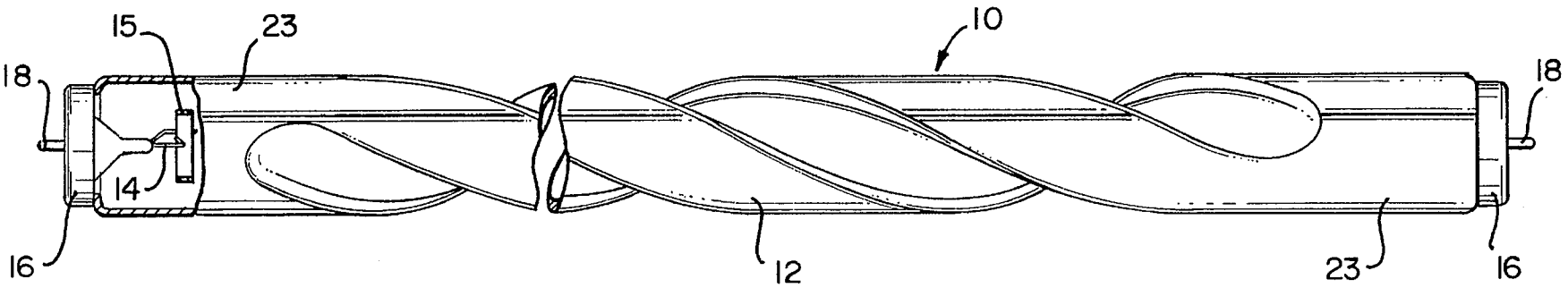
FIG. 1 is a perspective view of a lamp according to the subject invention.

The invention operates with fluorescent lamps whose envelopes have a full cylindrical configuration along their length as well as lamps which have one or more helical grooves along the length thereof. Lamps of the latter type are shown, for example, in U.S. Pat. Des No. 198,268 granted May 26, 1964, which is assigned to the Assignee of the subject application; U.S. Pat. No. 3,560,786 granted Feb. 2, 1971, also assigned to the Assignee of this application. The invention also operates with lamps of the type having discontinuous helical grooves such as shown, for example, in U.S. Pat. No. 3,988,633 granted Oct. 26, 1976 and which is assigned to the Assignee of the subject application, as well as U.S. Pat. Nos. 4,825,125 granted Apr. 25, 1989 and 3,331,674 granted Jul. 18, 1967.

A lamp 10 of the general type which is disclosed in the aforesaid U.S. Pat. Des No. 198,268 is shown in FIG. 1. As can be seen, there is an elongated envelope 12 which is made of any conventional material, such as soda-lime glass. If the lamp phosphors are not to transmit ultra-violet energy, the glass may have an ultra-violet blocking material added to the inner or outer surface.

Envelope 12 is of T10 outer size i.e., 10 one-eighth inch units making an outer diameter of nominal 1.25 inches. An electrode 14 extends into each end of the envelope and there can be a protective shield 15 around each of the electrodes. The shield has its usual function of collecting sputtered electrode material. Each electrode is mounted on an end cap 16, at least one of which has a tubulation (not shown) to exhaust and fill the envelope. Each end cap 16 has one or more pins 18 thereon which are connected to the electrode. The pins are to be placed in a socket to receive voltage from the ballast (not shown).

The envelope 12 has a quantity of mercury therein as an ionizable material as well as a fill gas. The quantity of mercury is controlled by preferably introducing a specific amount of mercury into a cavity embedded in a shield or from an intermetallic compound swaged onto the surface of the shield as disclosed in U.S. Pat. No. 3,657,589 by Sases, Italy. Any other suitable method can be used.

The fill gas is a mixture of neon and argon preferably in the approximate ratio, by volume, of 25% neon and 75% argon. Neon is not generally used in large percentages in a fluorescent lamp fill gas.

The envelope 12 is shown with one or more helical grooves which extends along the length of the envelope between a fully circular portion 23 at each end of the envelope. FIG. 1 shows a lamp with one helical groove but there can be two or more. Other groove types can be used as mentioned above.

The inner surface of the wall of the envelope 12 is coated with a phosphor. The selection of the phosphor blend determines the lumen output, lamp correlated color temperature and spectral distribution. The phosphor, as discussed below, preferably is of the 3 or 4 component type which uses narrow band rare earth types of phosphors. This general concept is described in U.S. Pat. No. 5,122,710 granted Jun. 16, 1992, which is assigned to the same assignee.

T8 lamps require the use of the more high temperature stable rare earth phosphors because of the reduced surface area of the lamp envelope. Although these phosphors are also preferred for use in the disclosed T10 lamp with the helical groove or grooves, the lamp also can utilize wide band phosphors for accurate natural daylight spectrum simulation. Also combinations of tri-band and wide band phosphor blends can be used for a more economic lighting "package" and a more continuous light spectrum than can be achieved with the use of only tri-band phosphors.

The use of the smaller diameter T10 envelope relative to a T12 envelope increases electron wall losses. The presence of one or more grooves in the lamp envelope reduces the effective envelope cross-section, thereby increasing wall losses to the arc stream further. Also, the length of the arc stream is increased since the arc stream is deflected and travels a path of somewhat serpentine shape due to the presence of the groove or grooves.

The use of the neon in addition to the conventional argon gas increases the voltage gradient. All of these factors assures that the required lamp voltage is obtained.

A preferred embodiment of the lamp of the present invention includes the following design characteristics:

1. Lamp Length: 48" nominal, 47.67"–47.78" from the end of the pin on one end to the end of pin on the opposite end.
2. Lamp Diameter: T10, 1¼" diameter, nominal. 1.310"–1.340" diameter.
3. Helical Groove Data:
   Pitch: 7½"
   Depth of Groove: ⅜"±1/16"
   Angle of Groove with respect to longitudinal axis of lamp: 16°–18°
   Cylindrical envelope length (23) at each end of envelope: 2½–3"
4. Fill Gas Mixture: 25% Neon, 75% Argon, by volume.
5. Fill Gas Pressure: 2.1–2.3 Torr.
6. Mercury Dosing Quantity: 25 mg minimum.
7. Lamp Voltage T8 Reference Ballast: 125–130 Volts
8. Lamp Voltage T12 Reference Ballast: 115–120 Volts The helical groove data (item 3. above), in combination with the basic T10 envelope, allows the use of standard wall thickness glass tubing (0.030" nominal) from which the envelope is fabricated. Structural reliability is achieved for the disclosed lamp using 0.030" thickness standard wall tubing in combination with the T10 envelope and the helical groove data shown.

In combination with the lamp design parameters listed above, several phosphor blends (given in terms of weight percentage of phosphors) having commercial tolerances have been used to achieve specific light output characteristics:

1. 4200K, 82 CRI, 2750 Lumens on T8 electromagnetic and electronic ballasts; 3100 Lumens on T12 electronic ballast
   44.7% Yttrium Oxide: Europium
   43.9% Lanthanum Cerium Terbium Phosphate: Europium
   11.4% Barium, Magnesium Aluminate: Europium
2. 5000K, 85 CRI, 2700 Lumens on T8 electromagnetic and electronic ballasts; 3060 Lumens on T12 electronic ballast
   40% Yttrium Oxide: Europium
   18% Lanthanum Cerium Terbium Phosphate: Europium
   42% Barium, Magnesium Aluminate: Europium
3. 5500 K, 91 CRI, 2350 Lumens on T8 electromagnetic and electronic ballasts; 2600 Lumens on T12 electronic ballast
   36.3% Strontium Borophosphate: Europium
   29.9% Yttrium Oxide: Europium
   19.7% Lanthanum Cerium Terbium Phosphate: Europium
   5.2% Barium, Magnesium, Aluminate: Europium
   8.9% Cerium (Barium Magnesium) Alumina: Cerium The following table illustrates the lamp voltages achieved as a function of envelope configuration and fill gas. To allow for meaningful comparisons, the industry practice of operating lamps on an American National Standard Reference Ballast was employed. This eliminates variations in lamp characteristics due to manufacturing tolerances inherent in commercial ballasts and allows true data comparisons for chosen variables.

| Lamp | Envelope | Fill Gas | Lamp Voltage | Reference Ballast Setting For |
|---|---|---|---|---|
| 1. 48" T12 | Cylinder | Argon | 103–105 | 40W T12 |
| 2. 48" T10 | Cylinder | Argon | 108–110 | 40W T12 |
| 3. 48" TH10 | Helical Groove | Argon | 110–115 | 40W T12 |
| 4. 48" TH10 | Helical Groove | Argon | 115–120 | 32W T8 |
| 5. 48" T10 | Cylinder | 25% Ne 75% Ar | 115–120 | 32W T8 |
| 6. 48" TH10 | Helical Groove | 25% Ne 75% Ar | 125–130 | 32W T8 |
| 7. 48" TH10 | Helical Groove | 25% Ne 75% Ar | 115–120 | 40W T12 |
| 8. 48" T8 | Cylinder | Argon | 132–137 | 32W T8 |

The letter "H" indicates an helical groove. Reference and commercial ballasts regulate lamp current. Any lamp voltage change is almost directly translated into a lamp wattage change.

Items 6 and 7 in the table above represents the parameters of the preferred embodiment lamp. This means that in a T8 ballast system the lamp operates at 30 watts vs. the 32 watts for T8 lamps. No Reference Ballast setting for the 40WT12 electronic system has been established by the American National Standards Institute C78-2 Committee.

Measurements on commercial electronic 40WT12 ballasts show that the preferred embodiment lamp operates over a wide wattage range of about 27 watts to 41 watts. No wattage reduction is obtained on this ballast compared to conventional lamps. However, the benefits of the lamp for the user, mentioned previously, apply.

Performance improvements are obtained when a lamp of the subject invention is replaced into a T8 luminaire having either a T8 electronic or magnetic ballast. These advantages include (1) reduced blackening, (2) improved lumen maintenance and (3) reduced lamp wattage and therefore reduced system wattage.

The same advantages are obtained when the lamp is used on a T12 electronic ballast. In addition, as should be clear, an inventory of only one lamp size is required for both T8 and T12 type lamp fixtures.

Reduced blackening is achieved because the shielded electrode construction is located further away from the inside wall surface of the T10 (1¼" diameter) envelope than is possible in a T8 (1" diameter) envelope. Even if the same amount of emission material is sputtered away from the electrode and onto the phosphor coated envelope wall, the larger available T10 surface area reduces the sputtered material concentration, thus reducing the saturated dark "rings" associated with lamp envelope end blackening. In envelopes with helical grooves the cylindrical shape sections 23 are maintained at the lamp ends. Thus, a surface area increase of about 25% in the vicinity of the electrodes in T10 envelopes is obtained as compared to T8 envelopes.

Lumen maintenance is improved due to the larger effective cross-section of the T10 helical grooved envelope, its resultant reduced current density and lower impact energy (bombardment) of mercury ions and electrons striking the phosphors adhering to the envelope wall. Phosphor discoloration is reduced and the rate of light loss throughout lamp life is also reduced.

Lamp and system wattage reduction in comparison to T8 lamps is achieved by the combination of neon/argon gas mixture and the helical groove configuration of the T10 envelope. All of these performance improvements are achieved with no sacrifice in initial lumen output or life.

The lamps of the subject invention operate successfully on T12electronic ballasts. They have advantages in that only a single inventory of lamp types is required for both T8 and T12 ballasts. In addition, the smaller diameter of the T10 is less costly to ship, requires less storage space and creates less waste when discarded. There is no perceived reduction in initial lumens or life in comparison to the T8 or T12 lamps it is designed to replace.

I claim:

1. A single fluorescent lamp having electrical voltages and wattage characteristics making it suitable for operation with both T8 and T12 electronic ballasts and T8 electromagnetic ballasts comprising:

an elongated envelope of T10 diameter dimension with an electrode at each end having an energizing voltage from the ballast, at least one groove in said envelope to reduce its overall cross-sectional dimension in the area where the groove exists and to react with the lamp arc stream discharge to increase the T10 envelope wattage loading and lamp voltage, a quantity of mercury within said envelope, a fill gas of neon and argon within said envelope with the quantity of neon being sufficient to further raise the operating voltage of the T10 envelope, and a blend of phosphors on the internal wall of said envelope reacting with the arc stream discharge of the ionized mercury for producing visible light as the lamp operates on any one of a T8 or T12 electronic ballast or T8 electromagnetic ballast.

2. A fluorescent lamp as in claim 1 wherein said phosphor blend comprises:

Yttrium Oxide: Europium

Lanthanum Cerium Terbium Phosphate: Europium

Barium, Magnesium Aluminate: Europium.

3. A fluorescent lamp as in claim 2 wherein the phosphor blend further comprises Cerium (Barium Magnesium) Alumina: Cerium.

4. A fluorescent lamp as in claim 2 wherein said phosphor blend comprises by weight:

44.7% Yttrium Oxide: Europium, 43.9% Lanthanum Cerium Terbium Phosphate: Europium;

11.4% Barium, Magnesium Aluminate: Europium.

5. A fluorescent lamp as in claim 2 wherein said phosphor blend comprises by weight:

40% Yttrium Oxide: Europium

18% Lanthanum Cerium Terbium Phosphate: Europium

42% Barium, Magnesium Aluminate: Europium.

6. A fluorescent lamp as in claim 1 wherein said phosphor blend comprises:

Strontium Borophosphate: Europium

Yttrium Oxide: Europium

Lanthanum, Cerium Terbium Phosphate: Europium

Barium, Magnesium, Aluminate: Europium

Cerium (Barium Magnesium) Alumina: Cerium.

7. A fluorescent lamp as in claim 6 wherein said phosphor blend comprises by weight:

36.3% Strontium Borophosphate: Europium 29.9% Yttrium Oxide: Europium 19.7% Lanthanum Cerium Terbium Phosphate: Europium 5.2% Barium, Magnesium, Aluminate: Europium 8.9% Cerium (Barium Magnesium) Alumina: Cerium.

8. A fluorescent lamp as in claim 1 wherein said groove comprises at least one elongated helical groove.

9. Fluorescent lamp as set forth in claim 2 wherein said groove has the following dimensions:

Pitch: 7½"

Depth of Groove: ⅜"±1/16"

Angle of Groove with respect to longitudinal axis of lamp: 16° to 18°

Cylindrical envelope length at each end: 2½"–3"

Cylindrical envelope nominal diameter 1¼".

10. A fluorescent lamp as in claim 1 wherein the fill gas is 25% neon and 75% argon by volume.

11. Fluorescent lamp as set forth in claim 3 wherein said groove has the following dimensions:

Pitch: 7½"

Depth of Groove: ⅜"±1/16"

Angle of Groove with respect to longitudinal axis of lamp: 16°–18°

Cylindrical envelope length at each end: 2½"–3"

Cylindrical envelope nominal diameter 1¼".

12. Fluorescent lamp as set forth in claim 6 wherein said groove has the following dimensions:

Pitch: 7½"

Depth of Groove: ⅜"±1/16"

Angle of Groove with respect to longitudinal axis of lamp: 16°–18°

Cylindrical envelope length at each end: 2½"–3"

Cylindrical envelope nominal diameter 1¼".

13. A fluorescent lamp as in claim 1 having standard wall thickness glass retaining sufficient strength to be used as a commercial product.

14. A fluorescent lamp as in claim 1 in which the envelope has at least one helical groove of sufficient depth to serve as a finger grip to aid in twisting the lamp into the fixture socket.

15. A fluorescent lamp as in claim 1 wherein there is 20 to 25 mg of mercury.

16. A fluorescent lamp as in claim 5 further comprising an ultra-violet blocking material on the inner or outer surface of said envelope.

17. A fluorescent lamp as in claim 15 further comprising a non-circular steel ribbon around the cathodes containing a specific quantity of mercury attached to the ribbon surface.

* * * * *